US007704447B2

(12) United States Patent
Danger et al.

(10) Patent No.: US 7,704,447 B2
(45) Date of Patent: Apr. 27, 2010

(54) MULTI-DECK FURNACE

(75) Inventors: Elisabeth Danger, Paderborn (DE); Kiyohito Kondo, Paderborn (DE)

(73) Assignees: Benteler Automobiltechnik GmbH, Paderborn (DE); Aisin Takaoka Co., Ltd., Toyota, Aichi-Pref. (JP)

( * ) Notice: Subject to any disclaimer, the term of this patent is extended or adjusted under 35 U.S.C. 154(b) by 313 days.

(21) Appl. No.: 11/743,920

(22) Filed: May 3, 2007

(65) Prior Publication Data

US 2007/0257407 A1 Nov. 8, 2007

(30) Foreign Application Priority Data

May 3, 2006 (DE) ..... 10 2006 020 781

(51) Int. Cl.
*F27D 3/06* (2006.01)

(52) U.S. Cl. ..... 266/249; 432/128

(58) Field of Classification Search ..... 266/249, 266/255; 432/122, 128, 129, 132, 137
See application file for complete search history.

(56) References Cited

U.S. PATENT DOCUMENTS

| | | | | |
|---|---|---|---|---|
| 2,106,506 | A * | 1/1938 | Pletcher et al. | 126/41 E |
| 6,662,710 | B1 * | 12/2003 | Kemppainen et al. | 99/334 |
| 2004/0020915 | A1 * | 2/2004 | Shei | 219/385 |

FOREIGN PATENT DOCUMENTS

| | | |
|---|---|---|
| DE | 1 433 769 | 12/1968 |
| EP | 0 313 726 | 5/1989 |
| GB | 820 220 | 9/1959 |
| GB | 2 292 999 | 3/1996 |
| GB | 2 301 660 | 12/1996 |

* cited by examiner

*Primary Examiner*—Scott Kastler
(74) *Attorney, Agent, or Firm*—Henry M. Feiereisen; Ursula B. Day

(57) ABSTRACT

A furnace for heating steel plates includes a plurality of horizontal furnace levels in superimposed disposition. Each furnace level is constructed for acceptance of at least one steel plate and includes a transport mechanism for moving the at least one steel plate during a heating process.

12 Claims, 2 Drawing Sheets

MULTI-DECK FURNACE

CROSS-REFERENCES TO RELATED APPLICATIONS

This application claims the priority of German Patent Application, Ser. No. 10 2006 020 781.5, filed May 3, 2006, pursuant to 35 U.S.C. 119(a)-(d), the content of which is incorporated herein by reference in its entirety as if fully set forth herein.

BACKGROUND OF THE INVENTION

The present invention relates, in general, to the field of furnaces for heating steel plates.

Nothing in the following discussion of the state of the art is to be construed as an admission of prior art.

Steel plates, in particular coated plates, intended for hot forming, are typically heated in a roller hearth furnace, whereby the steel plates are placed at a certain distance upon the roller table of the furnace. The rollers are made of ceramics and continuously transport the steel plates to be heated through the furnace towards the furnace exit. The furnace is sized in length in dependence on the required cycle time, size, and material properties of the steel plates to be shaped and may range from several meters to one hundred meters and more. Although the construction of furnaces of substantial length is technically feasible, their use is however discouraged because of the substantial space demand and the problem that the loading station of the furnace is positioned at a great distance away from the press that follows the furnace so that a single worker is unable to supervise the loading station and the press at the same time. As a result, control operation becomes more complicated, and a long furnace is also impractical for energy reasons because a lengthy furnace has a relatively large surface area in relation to a small inside volume. Lengthy furnaces also require a roller table that is equally sized in length, so that the risk for malfunction rises with increase in length of the furnace. In other words, when operation of such a furnace fails, the entire heat-treatment assembly including the associated press system must be shut down.

In particular when coated steel plates are involved, a continuous advance of the steel plates is absolutely required during the heating process because otherwise at least some regions of the plate may encounter a separation of the coating. This type of damage is caused by the heat transfer between the transport rolls and the steel plates. Tests have shown that the heat transfer in a blank steel plate is promoted by the rolls. Thus there is no option other than to maintain a continuous advance of the coated steel plates on the rollers in order to evenly heat the entire steel plate.

It would therefore be desirable and advantageous to provide an improved furnace for heating steel plates to obviate prior art shortcomings and to enable a high throughput rate for large-area coated steel plates of sizes that may reach several square meters while still requiring little space.

SUMMARY OF THE INVENTION

According to one aspect of the present invention, a furnace for heating steel plates includes a plurality of horizontal furnace levels in superimposed disposition, each furnace level constructed for acceptance of at least one steel plate, and a transport mechanism, provided in each furnace level, for moving the at least one steel plate during a heating process.

The present invention resolves prior art problems by providing a multi-deck furnace having many levels to stack the various steel plates. As a result, the hot forming process can be optimized. As the furnace according to the invention has at least two, suitably more than four, heated furnace levels that are arranged above one another, the need for space is substantially reduced compared to a stretched-out roll-over type furnace. In addition, the furnace according to the invention also allows coated steel plates to be evenly heated because each furnace level has its own transport mechanism to move the steel plates during heating operation.

According to another feature of the present invention, the transport mechanism may include transport rolls for supporting the at least one steel plate. This ensures even heating of the steel plates so that damage to a coating of the steel plate as a result of uneven heat exposure is prevented.

According to another feature of the present invention, the transport mechanism may be constructed to also reverse a translatory movement of the at least one steel plate in the furnace level. Reversal of the translatory movement results in a particularly space-saving construction of the furnace while still enjoying the benefits of an even heating exposure.

According to another feature of the present invention, the steel plate is charged in a charging direction, with the transport mechanism moving the at least one steel plate in a movement direction in correspondence to the charging direction. It is basically possible to move the steel plates in a furnace level transversely to the charging direction. However, a movement direction in the furnace in correspondence to the charging direction allows a simultaneous use of the transport rolls in a furnace level also for charging the steel plates so that the transition from a charging unit into the furnace level is simplified.

According to another feature of the present invention, a charging device may be provided which is height adjustable so as to be positionable to the height of the furnace level, when the furnace level is to be charged with the at least one steel plate. As a result, a single charging device may be used for charging any number of furnace levels.

According to another feature of the present invention, the charging device may be constructed for simultaneous application as a withdrawal device. In this way, the footprint of the furnace, including charging and withdrawal devices can even be further reduced. As the footprint of the furnace is already relatively small, it is also conceivable to position a withdrawal device on a side of the furnace opposite to the charging device and to construct the withdrawal device for height adjustment so as to be positionable at the height of the furnace level, when the at least one steel plate is to be removed from the furnace level. The charging device as well as the withdrawal device may include transport rolls for support of the steel plates and transfer of the steel plates into or out of the respective furnace levels.

According to another feature of the present invention, a heating unit may be disposed in proximity of the withdrawal device in order to avoid heat loss, when the steel plates exit the furnace. Suitably, the heating unit is arranged above the transport rolls of the withdrawal device. Suitably, a further heating unit is also disposed in proximity of a transfer station which is positioned adjacent to the withdrawal device and receives the steel plate therefrom. As a result, the heated steel plate can be transferred for further processing at the desired temperature.

According to another feature of the present invention, a separation is provided for thermal isolation of neighboring furnace levels, so that the neighboring furnace levels can be individually heated As a consequence, the individual furnace levels may, optionally, be heated to different temperatures. It is also possible, to shutdown individual furnace levels, when, for example, repair works are needed, while the remaining furnace levels may continue to operate. Thus, a defect of one furnace level does not necessarily cause downtimes of the entire furnace and the following press station. Rather, repair work can be delayed until the next scheduled maintenance, without completely stopping the production.

According to another feature of the present invention, neighboring furnace levels may be combined to a jointly heatable height zone of the furnace. In other words, there is no thermal isolation between the furnace levels in a height zone. The combination of furnace levels to common heatable zones ensures optimum heat balance within each zone.

According to another feature of the present invention, a drawer-type receptacle may be provided to interact with a furnace level, wherein the drawer-type receptacle has transport rolls for support of the at least one steel plate and is constructed to horizontally move in and out from the furnace level in order to charge and remove the at least one steel plate.

A furnace according to the present invention is able to significantly enhance the ratio between steel plates that can be heated simultaneously and the footprint of the furnace. A ratio of four steel plates per square meter footprint of the furnace seems possible.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
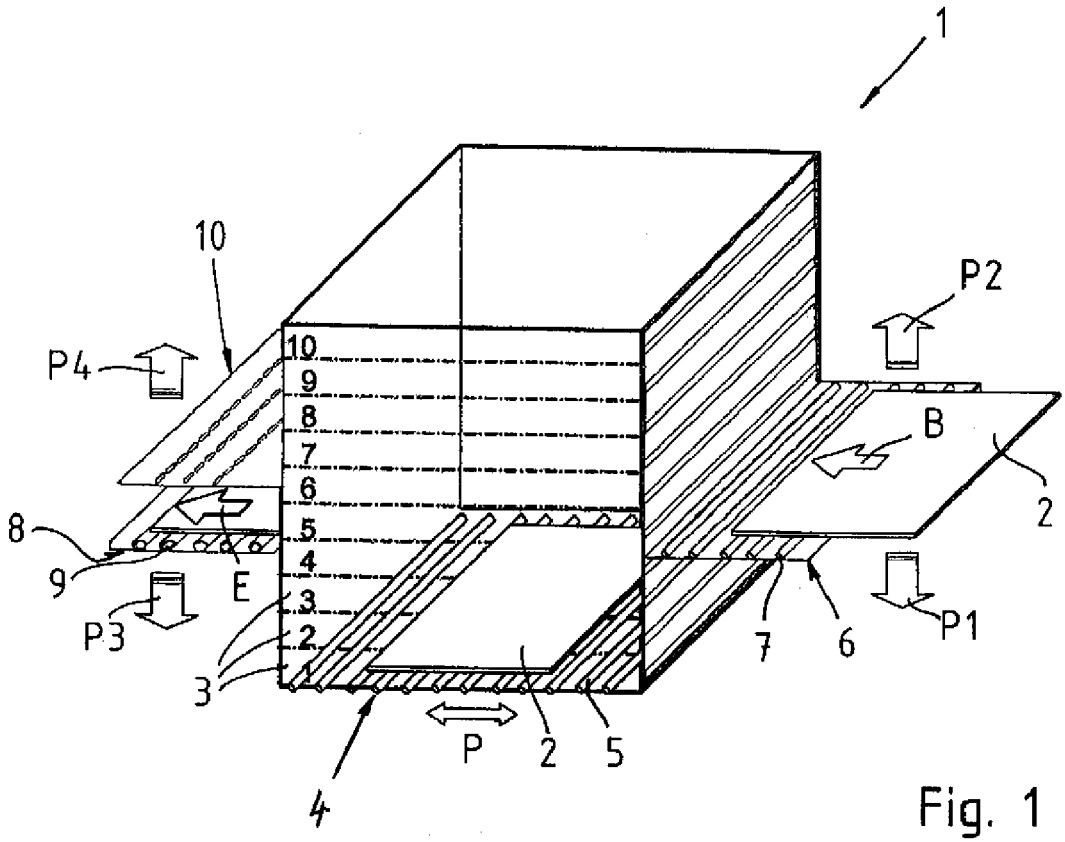
FIG. 1 is a schematic perspective illustration of one embodiment of a furnace according to the present invention.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic perspective illustration of one embodiment of a furnace according to the present invention, generally designated by reference numeral 1, for heating steel plates 2. The furnace 1 includes, by way of example, ten identical furnace levels 3, which are numbered 1 through 10 on the left hand side, and which are arranged above one another. Each furnace level 3 is constructed for accepting a steel plate 2. As in the non-limiting example of FIG. 1, the furnace levels 3 are of an identical construction, it will be understood by persons skilled in the art that a description of one of furnace level 3 is equally applicable to the other furnace levels 3.

FIG. 1 shows with respect to the lowermost one of the furnace levels 3, the acceptance of a steel plate 2 in the lowermost furnace level 3 and the support of the steel plate 2 on a transport mechanism, which is generally designated by reference numeral 4, and constructed for moving the steel plate 2 through the furnace level 3 while the steel plate 2 is heated. The transport mechanism 4 includes a plurality of transport rolls 5 in spaced-apart side-by-side relationship, and an unillustrated drive for operating the transport rolls 5. Arrow P indicates the translatory back-and-forth movement of the steel plates 2 by the transport rolls 5 during heating. The steel plates 2 are retained and moved in the furnace levels 3 until the steel plates 2 reach the desired temperature and the desired heating period.

The arrow P and thus the transport direction of the transport rolls 5 correspond to the charging direction, designated by arrow B. The furnace 1 is charged with steel plates 2 by means of a charging device, generally designated by reference numeral 6 and including transport rolls 7 which have a same orientation as the transport rolls 5 of the transport mechanism 4. The charging device 6 is height-adjustable and thus can be positioned at a level with the furnace level 3 to be charged. Arrows P1 and P2 indicate the up and down movement of the charging device 6.

Removal of the heated steel plates 2 is realized by a withdrawal device, generally designated by reference numeral 8 and positioned on a length side of the furnace 1 opposite to the charging device 6. The withdrawal device 8 includes transport rolls 9 having an orientation that corresponds to the orientation of the transport rolls 5 in the individual furnace levels 3. Thus, the discharge direction according to arrow E corresponds to the charging direction B. The withdrawal device 8 is also constructed for height adjustment, as indicated by arrows P3, P4 and thus movable up and down. A heating unit, generally designated by reference numeral 10, is disposed above the transport rolls 9 of the withdrawal device 8 for maintaining the heated steel plates 2 exiting the furnace levels 3 at a predefined temperature. The heating unit 10 is height-adjustable together with the withdrawal device 8.

Figure 2:
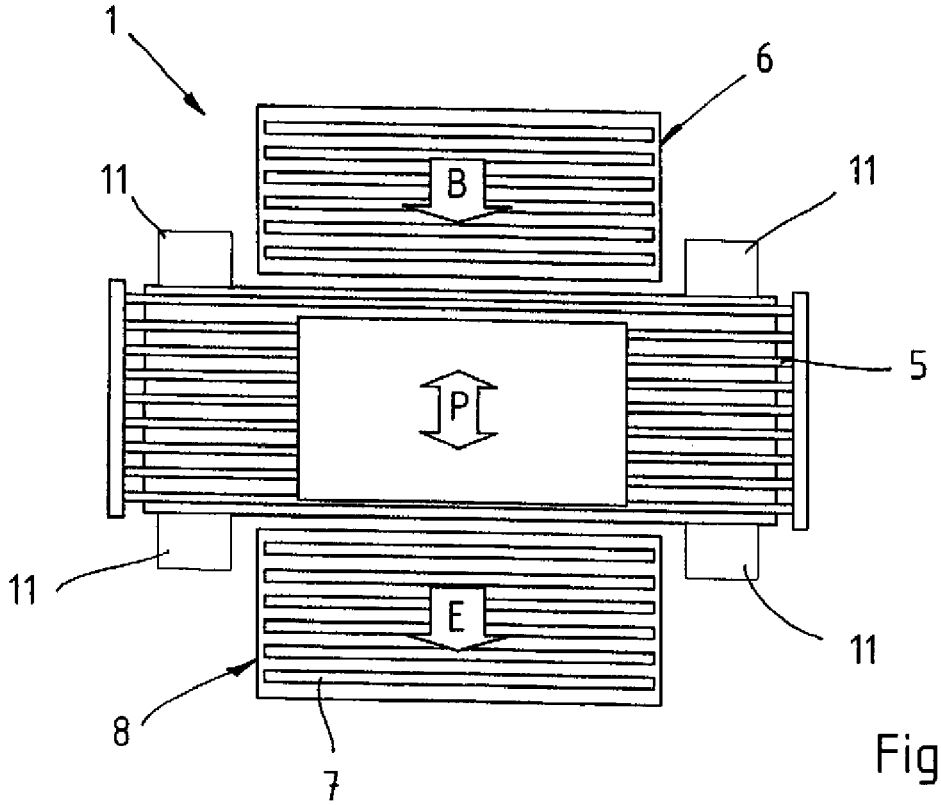
FIG. 2 is a horizontal section of one furnace level of the furnace of FIG. 1.

As shown in FIG. 2, the furnace 1 has a size which is only slightly greater than the steel plate 2 to be heated so that the ratio between the number of steel plates 2 that can be heated concurrently and the footprint of the furnace 1 is significantly greater than the ratio in a length roll-over type furnace with a single roller track.

FIG. 2 further shows, purely schematically, the provision of burners 11 in the corner areas of the furnace 1. In the drawing plane of FIG. 2, the charging device 6 is shown in an upper region while the withdrawal device 8 is positioned in a lower region.

Figure 3:
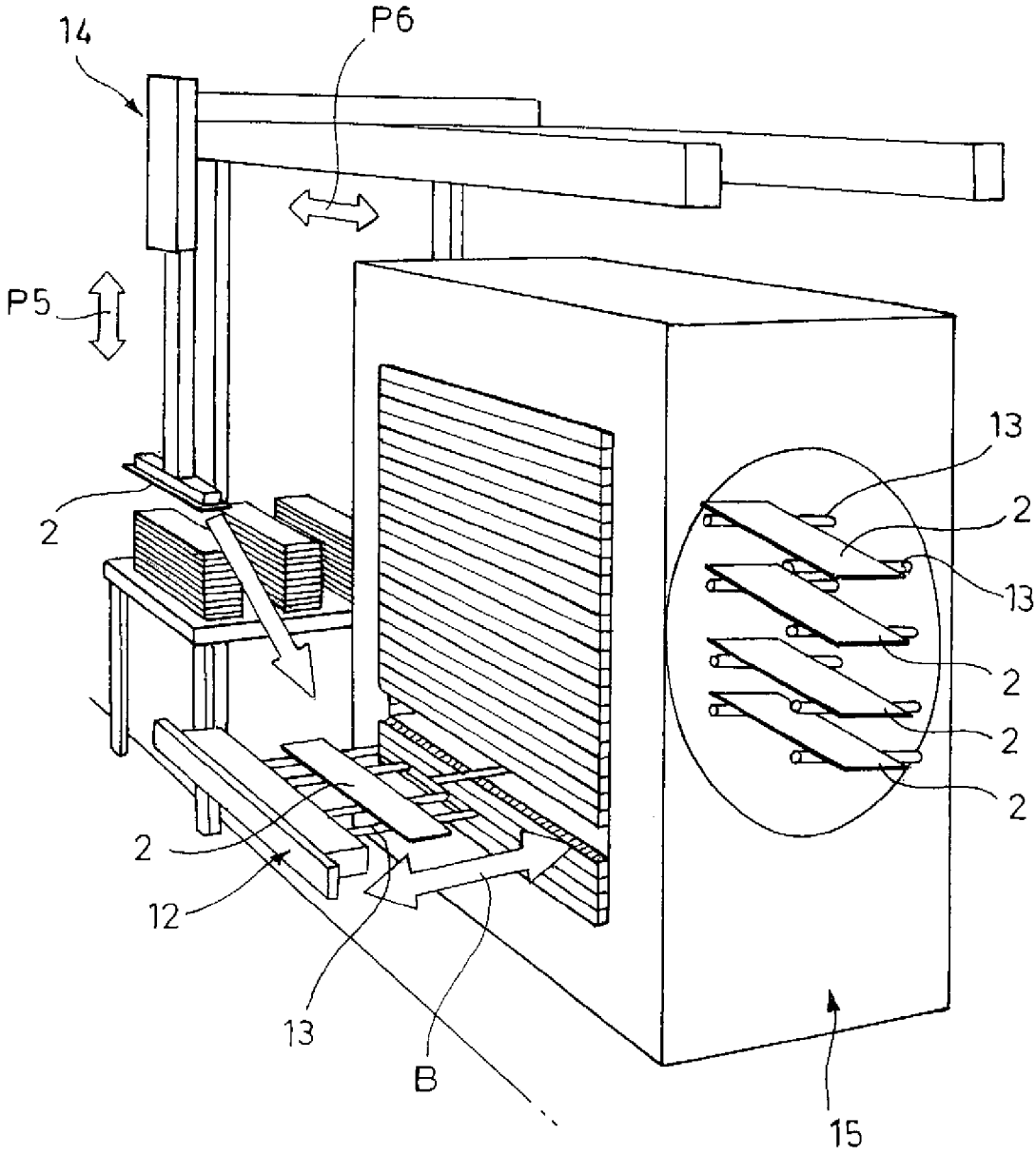
FIG. 3 is a perspective illustration of another embodiment of a furnace according to the present invention.

Referring now to FIG. 3, there is shown a perspective illustration of another embodiment of a furnace according to the present invention, generally designated by reference numeral 15. The description below will center on the differences between the embodiments. In this embodiment, each of the furnace levels includes a drawer-type receptacle 12 which has a bottom formed by support rolls 13 to support the steel plates 2. The drawer-type receptacle 12 is constructed to horizontally move in and out from the furnace levels so as to charge and remove the steel plates 2. A charging and withdrawal station 14 is implemented in this embodiment by a biaxial robot which is able to grab a steel plate 2 and move it up and down in the direction of double arrow P5 and to move it sideways in the direction of double arrow P6 so as to transport the steel plate 2 to and from the respective drawer-type receptacle 12. The bottom-forming support rolls 13 of the drawer-type receptacle 12 have a same orientation as the withdrawal direction, designated by arrow B which also corresponds to the charging direction. The steel plates 2 move in the furnace 15 at a right angle to the charging direction.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A furnace for heating steel plates, comprising:

a plurality of horizontal furnace levels in superimposed disposition, each said furnace level constructed for acceptance of at least one steel plate;

a transport mechanism, provided in each furnace level, for moving the at least one steel plate during a heating process; and a drawer-type receptacle interacting with the furnace level, wherein the drawer-type receptacle has a bottom formed by support rolls for support of the at least one steel plate and is constructed to move in and out from the furnace level in order to charge and withdraw the at least one steel plate.

2. The furnace of claim 1, wherein the transport mechanism includes transport rolls for supporting the at least one steel plate.

3. The furnace of claim 1, wherein the transport mechanism is constructed to allow a translatory back-and-forth movement of the at least one steel plate in the furnace level.

4. The furnace of claim 1, further comprising a charging device which is height adjustable so as to be positionable at a height of the furnace level, when the furnace level is to be charged with the at least one steel plate.

5. The furnace of claim 4, wherein the charging device is constructed for simultaneous application as a withdrawal device to define a combined charging and withdrawal device.

6. The furnace of claim 5, further comprising a heating unit disposed in proximity of the charging and withdrawal device.

7. The furnace of claim 6, wherein the charging and withdrawal device is height adjustable to a height of a transfer station for transfer of the at least one steel plate after exiting the furnace level in a heated state.

8. The furnace of claim 7, further comprising a further heating unit disposed in proximity of the transfer station.

9. The furnace of claim 1, further comprising a separation for realizing a thermal isolation between neighboring furnace levels so as to allow individual heating of neighboring furnace levels.

10. The furnace of claim 1, wherein neighboring furnace levels define a jointly heatable height zone of the furnace.

11. The furnace of claim 1, wherein the steel plate is charged in a charging direction, wherein the at least one steel plate moves in the furnace level at a right angle to the charging direction.

12. The furnace of claim 5, wherein the charging and withdrawal device includes a biaxial robot configured to grab the at least one steel plate and to move it up and down in a vertical direction and to move it sideways in a horizontal direction so as to transport the at least one steel plate to and from the drawer-type receptacle.

* * * * *